US007347328B2

(12) United States Patent
Hartwall

(10) Patent No.: US 7,347,328 B2
(45) Date of Patent: Mar. 25, 2008

(54) COLLAPSIBLE CONTAINER FOR TRANSPORT AND STORAGE

(75) Inventor: Peter Hartwall, Perstorp (SE)

(73) Assignee: Arca Systems AG, Perstorp (SE)

( * ) Notice: Subject to any disclaimer, the term of this patent is extended or adjusted under 35 U.S.C. 154(b) by 316 days.

(21) Appl. No.: 10/491,624

(22) PCT Filed: Oct. 1, 2002

(86) PCT No.: PCT/SE02/01784

§ 371 (c)(1),
(2), (4) Date: Aug. 11, 2004

(87) PCT Pub. No.: WO03/029090

PCT Pub. Date: Apr. 10, 2003

(65) Prior Publication Data

US 2004/0256385 A1 Dec. 23, 2004

(30) Foreign Application Priority Data

Oct. 4, 2001 (SE) ..... 0103332

(51) Int. Cl.
*B65D 19/00* (2006.01)

(52) U.S. Cl. ..... 206/600

(58) Field of Classification Search ..... 206/386, 206/600, 595, 597–599; 220/1.5, 6, 7, 666, 220/684, 686, 4.28, 682, 677
See application file for complete search history.

(56) References Cited

U.S. PATENT DOCUMENTS 2,801,761 A * 8/1957 Pigatti et al. ..... 217/12 R
3,941,271 A * 3/1976 Zarges et al. ..... 220/6
4,163,495 A * 8/1979 Drader ..... 206/506
4,674,647 A 6/1987 Gyenge et al.
4,809,851 A 3/1989 Oestreich
4,917,255 A * 4/1990 Foy et al. ..... 220/6
5,161,709 A * 11/1992 Oestreich, Jr. ..... 220/6
5,555,980 A * 9/1996 Johnston et al. ..... 206/600
6,135,287 A 10/2000 Hartwall
6,209,741 B1 * 4/2001 Boucher-Giles ..... 220/6
6,966,449 B2 * 11/2005 Williams ..... 220/4.31

FOREIGN PATENT DOCUMENTS

DE 3500427 7/1986
IL EP0071467 A2 * 2/1983 ..... 206/600
JP 01254544 10/1989

(Continued)

OTHER PUBLICATIONS

International Search Report mailed Jan. 8, 2003.

*Primary Examiner*—Luan K Bui
(74) *Attorney, Agent, or Firm*—Stevens, Davis, Miller & Mosher LLP

(57) ABSTRACT

Collapsible container which includes a base member, collapsible side walls, which adjacent side walls are interconnectable. The base member is provided with feet members, a circumambient edge and a mainly horizontal load surface. The load surface is provided with recesses extending downwards from the load surface, said recesses being arranged adjacent the edge. At least one side wall is provided with downwards extending protrusions, said protrusions being arranged to interact with said recesses. Said at least one side wall engages the base member through vertical motion.

4 Claims, 4 Drawing Sheets

FOREIGN PATENT DOCUMENTS

| | | |
|---|---|---|
| JP | 0575126 | 10/1993 |
| JP | 0672437 | 3/1994 |
| JP | 0649334 | 7/1994 |
| JP | 07033145 | 2/1995 |
| JP | 0724726 | 5/1995 |
| JP | 07232733 | 9/1995 |
| JP | 0891371 | 4/1996 |
| JP | 09309529 | 12/1997 |
| SE | 512519 | 3/2000 |
| WO | 0147780 | 7/2001 |

* cited by examiner

COLLAPSIBLE CONTAINER FOR TRANSPORT AND STORAGE

This application is a §371 Application of International Application No. PCT/SE02/01784, filed on Oct. 1, 2002, claiming the priority of Swedish Application No. 0103332-3, filed Oct. 4, 2001, the entire disclosure of which is incorporated herein by reference in its entirety.

The present invention relates to collapsible container such as a collapsible pallet container for transport and storage.

Collapsible containers of the foldable pallet container type, are rather popular since they will make a radical saving of the empty return transport volume possible. Foldable pallet containers are advantageously made of thermoplastic materials which will give light and still sturdy containers which are easy to keep clean. Another advantage is that the tare-weight of such containers is very stable which is not the case with, for example, wood containers where the tare-weight can double when the wood becomes wet. Yet another advantage is that thermoplastic materials do not corrode, which is the case with containers made from metal such as steel and aluminium. Most thermoplastic materials furthermore have a good resistance to chemical substances such as acids and bases, which is not the case with most metals.

Most collapsible containers available suffer from the disadvantage that they are bulky, inflexible when handled.

Through the present invention a novel collapsible container with great flexibility has been achieved. The invention relates to a collapsible container, preferably a collapsible pallet container for transport and storage. The collapsible container includes a base member and collapsible side walls, which adjacent side walls are inter-connectable. The invention is characterised in that the base member is provided with feet members, a circumambient edge and a mainly horizontal load surface whereby the load surface is provided with recesses extending downwards from the load surface. Said recesses are arranged adjacent the edge. At least one side wall is provided with downwards extending protrusions, said protrusions being arranged to interact with said recesses. Said at least one side wall engages the base member through vertical motion.

According to one embodiment of the invention the side wall is provided with a claw while the circumambient edge is provided with a void, said claw and void being arranged to interact so that an erected side wall will be prevented from being unintentionally disengaged from the base member. The claw of the side wall is preferably disengaged from the void of the circumambient edge through the process of by being angled slightly inwards followed by lifting the side wall.

The side walls are suitably provided coupling means at their respective vertical edges, said coupling means being intended to lock adjacent side walls together when they are in erected position. Said coupling means locking being disengaged by lifting said side wall and said coupling means being engaged by allowing said side wall to move downwards when erected in correct position adjacent other erected side wall. At least two side walls, arranged on opposite sides of the container, are suitably provided with locking means. Said locking means are used for locking adjacent side walls together when the side walls are in erected position.

The protrusions are according to one embodiment of the invention movably attached to the side wall via a hinge member.

According to one embodiment of the invention the protrusions are provided with snapping heels while the recesses are provided with undercuts. The snapping heels and undercuts are adapted to interact, limiting the vertical movement of the protrusions and thereby the side wall. The recesses, the undercuts, the protrusions and the snapping heels are suitably arranged to allow a limited vertical movement so that the protrusion, and thereby the side wall, will be located in a lowermost position when the side wall is in erected position and in a higher position when the protrusion, and thereby the side wall, is in folded position. The side wall is suitably provided with a claw while the circumambient edge is provided with a void, said claw and void being arranged to interact so that an erected side wall will be prevented from being unintentionally disengaged from the base member. The claw of the side wall is disengaged from the void of the circumambient edge through the process of being angled slightly inwards followed by lifting the side wall.

According to one embodiment of the invention the lower end of the side wall is provided with a stabilizing low rib intended to interact with a groove arranged on the base member. Said stabilizing low rib will hereby fall into said groove when said side wall is in erected position. The side wall is hereby folded through the process of being lifted slightly to disengage the stabilizing low rib from the groove before folding said side wall from erected position to folded position.

At least two opposite side walls are each provided with a first and a second horizontal folding line by being provided with hinges. The first horizontal folding line constitutes a lower end of the side wall at which the side wall connects with the base member. The second horizontal folding line, which divides the side wall into an upper side wall part and a lower side wall part, is placed at a distance from the first horizontal folding line, between the lower end and an upper rim of the side walls. The two horizontal folding lines are mainly parallel.

The invention also relates to a process where the collapsible container is folded sequentially by folding the upper side wall part towards the lower side wall part. Said wall parts hereby becomes mainly parallel. The partly folded side wall is then folded towards the load surface. The procedure is repeated for the opposite side wall whereupon the two remaining side walls are, one after the other, folded on top of the two, first folded, side walls.

According to an alternative embodiment of the invention the collapsible container is folded sequentially by folding the upper side wall part towards the lower side wall part so that said wall parts becomes mainly parallel. The procedure is repeated for the opposite side wall whereupon the two remaining side walls are, one after the other, folded towards the load surface. Said two side walls, consisting of upper and lower side wall parts, are then folded on top of the side walls already arranged on the load surface.

The collapsible container is according to one special embodiment folded sequentially by folding the upper side wall part towards the lower side wall part so that said wall parts becomes mainly parallel. The folded side wall is then folded towards the load surface. The procedure is repeated for the opposite side wall whereupon the two remaining side walls, which are also divided into upper side wall parts and lower side wall parts, are folded, one after the other, on top of the two first folded side walls by repeating the procedure of the first side wall.

The divided side walls are suitably provided with a link member used for movably connecting the upper side wall part to the lower side wall part. The upper edge of said lower side wall part and the lower edge of said upper side wall part are provided with protrusions and matching recesses which are intended to interact. Said link member is attached to at least one of said side wall parts via an oblong hole allowing the protrusions and recesses of the side wall parts to be distanced from each other by forcing them apart thereby allowing folding of said upper side wall part and that stability is achieved when said divided side wall is in erected state.

The side walls are suitably also provided coupling means at their respective vertical edges, said coupling means being intended to lock adjacent side walls together when they are in erected position. Said coupling means locking are disengaged by lifting said side wall and said coupling means being engaged by allowing said side wall to move downwards when erected in correct position adjacent other erected side wall.

According to one embodiment of the invention the side walls are provided coupling means at their respective vertical edges. Said coupling means are intended to lock adjacent side walls together when they are in erected position. Said coupling means locking is disengaged by lifting the upper side wall part and said coupling means is engaged by allowing said side wall to move downwards when erected in correct position adjacent other erected side wall.

The divided side wall is suitably provided with a clamping means being arranged at the second horizontal folding line. Said clamping means are used for clamping the upper side wall part and the lower side wall part together at times where folding is not desired. These clamping means are suitably movably integrated with the side wall.

At least two side walls, arranged on opposite sides of the container, are suitably provided with locking means. Said locking means are used for locking adjacent side walls together when the side walls are in erected position.

The base part preferably has the basic shape of a pallet provided with feet and skids making it possible to handle the container with mechanical means such as a fork lift.

A collapsible container according to the present invention is preferably manufactured through injection moulding, vacuum moulding, blow moulding or press moulding of one or more polymeric materials such as polyethylene, polypropylene, polybutene, polyvinylchloride, polyalkylene-therephtalate, acrylonitrile-butadiene-styrene copolymer, polyamide, polycarbonate or the like. Since the desired material characteristics of the different parts that the container is made up of can vary from part to part it is possible to add different additives to the thermoplastic material that will make this possible. As examples of such known additives can be mentioned ethylene-vinyl-acetate and rubber beads which will make the material more ductile and more impact resistant, but on the other hand more disposed to thermal creepage, or glass fibre, carbon fibre, steel fibre or aramide fibre which will make the material more rigid, less disposed to thermal creepage but on the other hand more brittle.

The invention is illustrated further through the enclosed figures showing embodiments of the invention whereby, FIG. 1 shows schematically and in perspective and exploded view a collapsible container 1 according to first embodiment of the invention.

FIG. 2 shows schematically and in perspective view a collapsible container 1 according to second embodiment of the invention.

FIG. 3 shows schematically and in perspective view corner parts of a base member 2 and lower portions of a side wall 3 of a collapsible container 1 according to the invention.

Figure 6A:
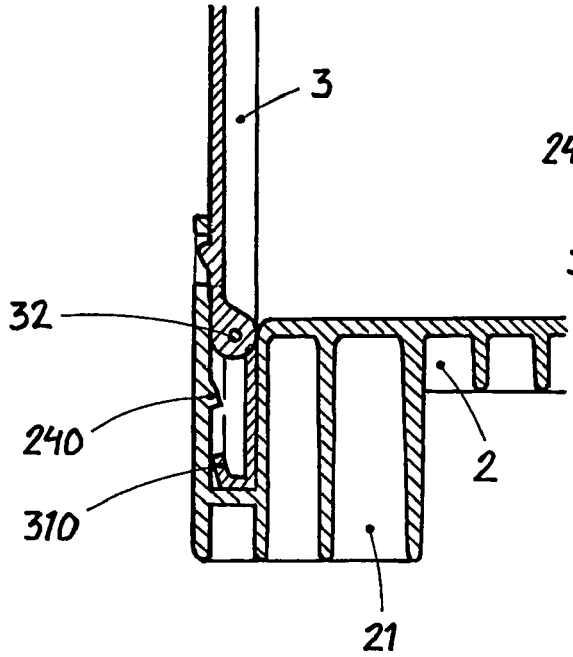
Figure 6B:
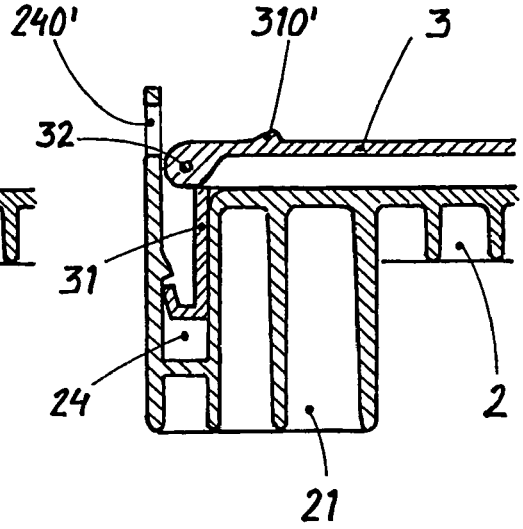

FIGS. 6*a* and 6*b* show schematically and in cross-section lower portions of a collapsible container 1 according to the invention where a side wall 3 is movably connected to a base member 2.

Figure 6C:
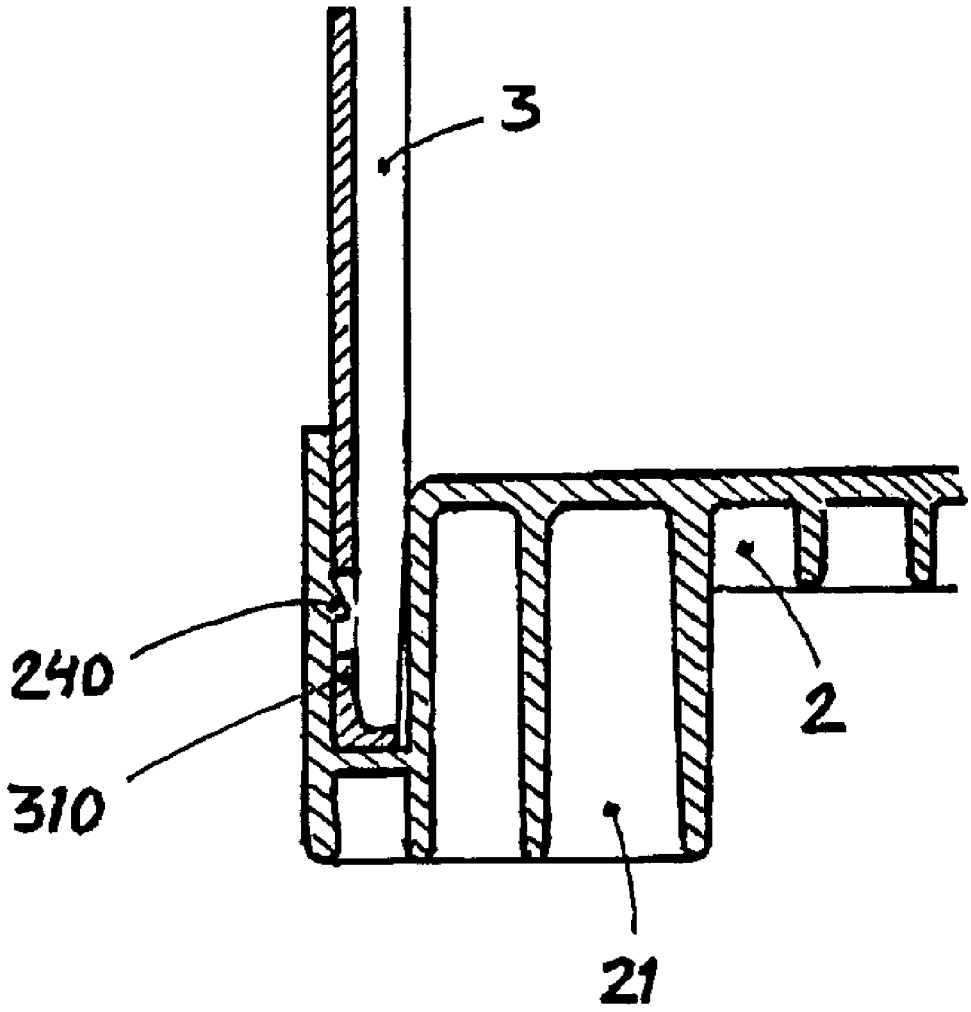

FIG. 6*c* shows an schematically alternative embodiment of a collapsible container 1 according to the invention.

Figure 7:
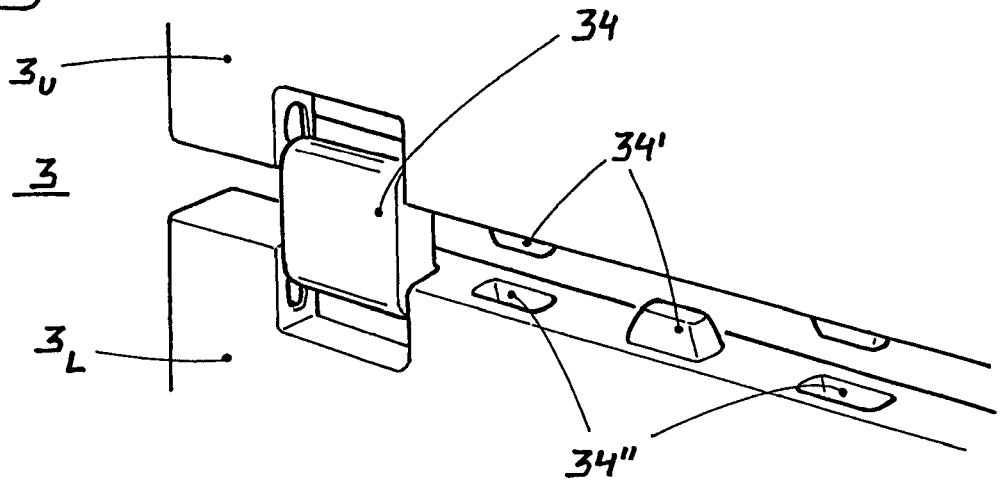

FIG. 7 shows schematically and in perspective view, seen from the outside, parts of a collapsible container 1 according to the invention where an upper side wall part $\mathbf{3}_U$ and a lower side wall part $\mathbf{3}_L$ are movably connected to one another.

Figure 1:
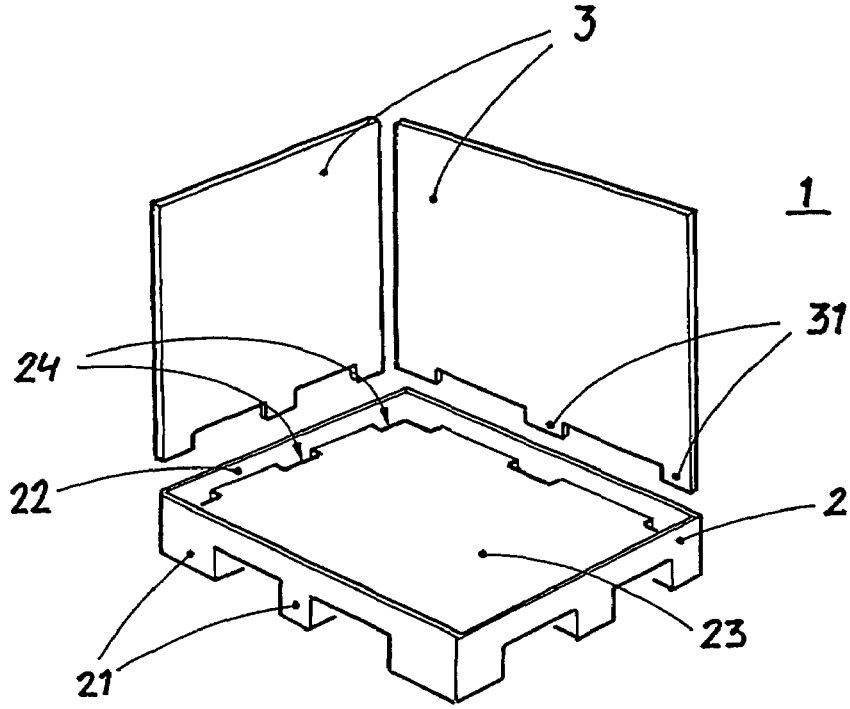
Figure 4:
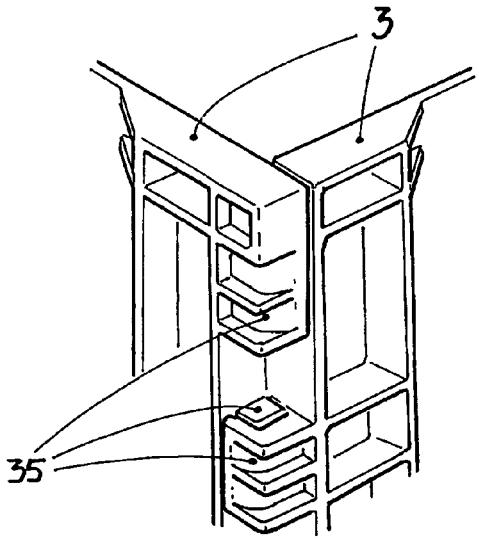
FIG. 4 shows schematically and in perspective view, seen from the outside, upper corner parts of a collapsible container 1 where two side walls 3 are connected to one another.
Figure 5:
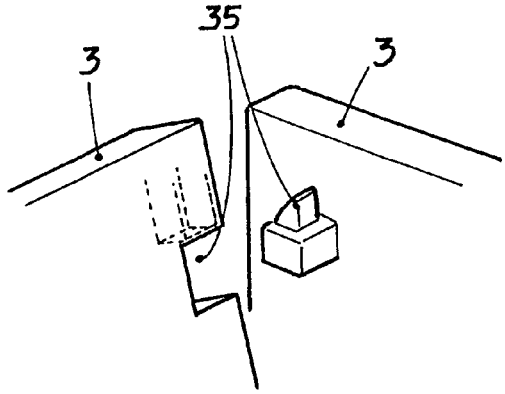
FIG. 5 shows schematically and in perspective view, seen from the inside, upper corner parts of a collapsible container 1 where two adjacent side walls 3 are in the process to be connected to one another.

FIG. 1 shows schematically and in perspective and exploded view a collapsible container 1 according to first embodiment of the invention. The collapsible container 1 includes a base member 2 and collapsible side walls 3. The base member 2 is provided with feet members 21, a circumambient edge 22 and a mainly horizontal load surface 23. The load surface 23 is provided with recesses 24 extending downwards from the load surface 23. The recesses 24 are arranged adjacent the edge 22. All four side walls 3 (only two shown) are provided with downwards extending protrusions 31 said protrusions 31 being arranged to interact with said recesses 24. The side walls 3 engages the base member 2 through vertical motion. The lower ends of the side walls 3 are provided with a stabilizing low rib 33 (see FIG. 3) intended to interact with a groove 25 (see FIG. 3) arranged on the base member 2 wherein said stabilizing low rib 33 falls into said groove 25 when said side wall 3 is in erected position. Portions of the cirumambient edge 22 has for the reason of clarity been cut away in FIG. 3. The side walls 3 are further provided coupling means 35 (see FIGS. 4 and 5) at their respective vertical edges. The coupling means 35 are intended to lock adjacent side walls 3 together when they are in erected position. The coupling means 35 locking is disengaged by lifting said side wall 3 a specified distance whereby said side wall 3 is tilted. The coupling means 35 are engaged by allowing said side wall 3 to move downwards when erected in correct position adjacent other erected side wall 3. Two side walls 3, arranged on opposite sides of the container 1, may also be provided with locking means. Said locking means being used for locking adjacent side walls together when the side walls 3 are in erected position. Two of the side walls 3, preferably arranged on opposite sides, may also be provided with claws 310' as shown in FIGS. 6*a* and 6*b* while the circumambient edge 22 is provided with a void 240' also shown in FIGS. 6*a* and 6*b*. The hinge member 32 isn't present in this special embodiment. The claws 310' and voids 240' are arranged to interact so that an erected side wall 3 will be prevented from being unintentionally disengaged from the base member 2. The claws 310' are disengaged from the voids 240' by tilting the side wall 3 inwards after having removed or folded the adjacent side walls 3.

Figure 2:
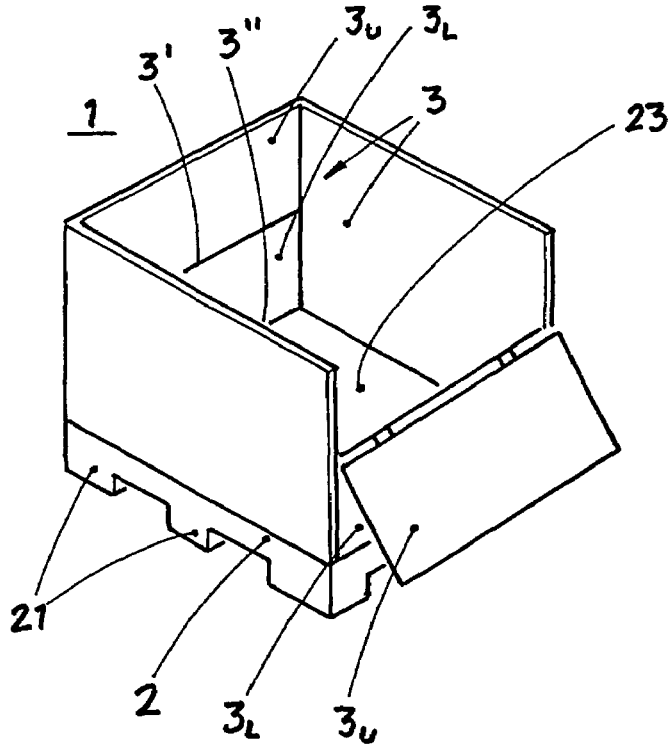

FIG. 2 shows schematically and in perspective view a collapsible container 1 according to second embodiment of the invention. The collapsible container 1 includes a base member 2 and collapsible side walls 3. The base member 2 is provided with feet members 21, a circumambient edge 22 (see FIG. 1) and a mainly horizontal load surface 23. The load surface 23 is provided with recesses 24 (see FIG. 1) extending downwards from the load surface 23. The recesses 24 are arranged adjacent the edge 22. All four side walls 3 are provided with downwards extending protrusions 31 (see FIG. 1) said protrusions 31 being arranged to interact with said recesses 24. The side walls 3 engages the base member 2 through vertical motion. The lower ends of the side walls 3 are provided with a stabilizing low rib 33 (see FIG. 3) intended to interact with a groove 25 (see FIG. 3) arranged on the base member 2 wherein said stabilizing low rib 33 falls into said groove 25 when said side wall 3 is in erected position. Two opposite side walls 3 are each provided with a first and a second horizontal folding line 3'and 3" respectively by being provided with hinges. The first horizontal folding line 3' constitutes a lower end of the side wall 3 at which the side wall 3 connects with the base member 2. The second horizontal folding line 3", which divides the side wall 3 into an upper side wall part $\mathbf{3}_U$ and a lower side wall part $\mathbf{3}_L$, is placed at a distance from the first horizontal folding line 31, between the lower end and the upper rim of the side walls 3. The two horizontal folding lines 3' and 31" respectively are mainly parallel. The divided side walls 3 are provided with a link member 34 (see FIG. 7) used for movably connecting the upper side wall part $\mathbf{3}_U$ to the lower side wall part $\mathbf{3}_L$. The upper edge of said lower side wall part $\mathbf{3}_L$ and the lower edge of said upper side wall part $\mathbf{3}_U$ are also provided with protrusions 34' and matching recesses 34" which are intended to interact. Said link member 34 is attached to the side wall parts $\mathbf{3}_U$ and $\mathbf{3}_L$ respectively via oblong holes allowing the protrusions and recesses of the side wall parts $\mathbf{3}_U$ and $\mathbf{3}_L$ respectively to be distanced from each other by forcing them apart thereby allowing folding of said upper side wall part $\mathbf{3}_U$. Stability is achieved when said divided side wall 3 is in erected state. The divided side walls 3 may also be provided with a clamping means being arranged at the second horizontal folding line 3". The clamping means is used for clamping the upper side wall part $\mathbf{3}_U$ and the lower side wall part $\mathbf{3}_L$ together at times where folding is not desired. The upper part of the side walls 3 adjacent to the divided side walls 3 as well as the upper side wall part $\mathbf{3}_U$ may further be provided coupling means 35 (see FIGS. 4 and 5) at their respective vertical edges. The coupling means 35 are intended to lock adjacent side walls 3 together when they are in erected position. The coupling means 35 locking is disengaged by lifting said upper side wall part $\mathbf{3}_U$ a specified distance whereby said upper side wall part $\mathbf{3}_U$ is tilted. The coupling means 35 are engaged by allowing said upper side wall part $\mathbf{3}_U$ to move downwards when erected in correct position adjacent other erected side wall 3.

The remaining parts of the side walls 3 may also be provided coupling means 35 (see FIGS. 4 and 5) at their respective vertical edges. The coupling means 35 are intended to lock adjacent side walls 3 together when they are in erected position. The coupling means 35 locking is disengaged by lifting said side wall 3 a specified distance whereby said side wall 3 is tilted. The coupling means 35 are engaged by allowing said side wall 3 to move downwards when erected in correct position adjacent other erected side wall 3. Two side walls 3, arranged on opposite sides of the container 1, may also be provided with locking means. Said locking means being used for locking adjacent side walls together when the side walls 3 are in erected position. Two of the side walls 3, preferably arranged on opposite sides may also be provided with claws 310' as shown in FIGS. 6*a* and 6*b* while the circumambient edge 22 is provided with a void 240' also shown in FIGS. 6*a* and 6*b*. The hinge member 32 isn't present in this special embodiment. The claws 310' and voids 240' are arranged to interact so that an erected side wall 3 will be prevented from being unintentionally disengaged from the base member 2. The claws 310' are disengaged from the voids 240' by tilting the side wall 3 inwards after having removed or folded the adjacent side walls 3.

FIGS. 6*a* and 6*b* show schematically in cross-section a special embodiment of protrusions 31 and recesses 24. The protrusions 31 are movably attached to the side wall 3 via a hinge member 32. The protrusions 31 are furthermore provided with snapping heels 310 while the recesses 24 are provided with undercuts 240. The snapping heels 310 and undercuts 240 are adapted to interact, limiting the vertical movement of the protrusions 31 and thereby the side wall 3. The undercuts 240, the protrusions 31 and the snapping heels 310 are arranged to allow a limited vertical movement so that the protrusion 31, and thereby the side wall 3, will be located in a lowermost position when the side wall 3 is in erected position (see FIG. 6*a*) and in a higher position when the protrusion 31, and thereby the side wall 3, is in folded position (see FIG. 6*b*). The side wall 3 may furthermore be provided with a claw 310' while the circumambient edge 22 is provided with a void 240'. Said claw 310' and void 240' are arranged to interact so that an erected side wall 3 will be prevented from being unintentionally disengaged from the base member 2. The claw 310' of the side wall 3 is disengaged from the void 240' of the circumambient edge 22 by being angled slightly inwards followed by lifting the side wall 3. FIG. 6*c* shows where the side walls 3 are not foldable, but allows an outwards angling for releasing a locking mechanism at the bottom of the recess 24.

Figure 3:
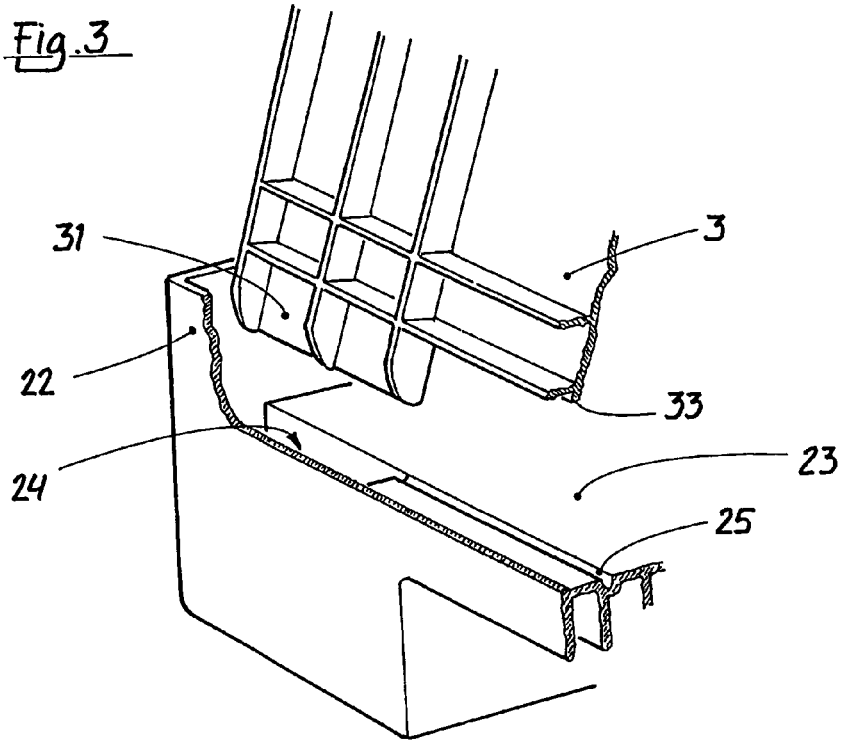

The present invention is not limited by the embodiments shown as it is possible to make different alternatives within the scope if the invention. It for example possible to provide a container according to the invention with three side walls 3 connected to the base member 2 via hinged protrusions 31 as shown in the FIGS. 6*a* and 6*b* while the fourth side wall is provided with solid protrusions as shown in FIGS. 1 and 3. This will facilitate loading and emptying of such a collapsible container 1 as one of the side walls 3 can be removed during handling.

The invention claimed is:

1. Collapsible container which collapsible container includes a base member, collapsible side walls, which adjacent side walls are inter-connectable, wherein the base member is provided with feet members, a circumambient edge and a mainly horizontal load surface whereby the load surface is provided with recesses extending downwards from the load surface, said recesses being arranged adjacent the edge and that at least one side wall is provided with downwards extending protrusions, said protrusions being arranged to interact with said recesses, that said at least one side wall engages the base member through vertical motion, wherein at least two opposite side walls each are provided with a first and a second horizontal folding line by being provided with hinges, which first horizontal folding line constitutes a lower end of the side wall at which the side wall connects with the base member and which second horizontal folding line, which divides the side wall into an upper side wall part and a lower side wall part, is placed at a distance from the first horizontal folding line, between the lower end and an upper rim of the side walls and that the two horizontal folding lines are mainly parallel, and the divided side walls are provided with a link member used for movably connecting the upper side wall part to the lower side wall part, that the upper edge of said lower side wall part and the lower edge of said upper side wall part are provided with protrusions and matching recesses which are intended to interact, that said link member is attached to at least one of said side wall parts via an oblong hole allowing the protrusions and recesses of the side wall parts to be distanced from each other by forcing them apart thereby allowing folding of said upper side wall part and that stability is achieved when said divided side wall is in erected state.

2. Collapsible container according to claim 1, wherein the side walls are provided coupling means at their respective vertical edges, said coupling means being intended to lock adjacent side walls together when they are in erected position, said coupling means locking being disengaged by lifting the upper side wall part and said coupling means being engaged by allowing said side wall to move downwards when erected in correct position adjacent other erected side wall.

3. Collapsible container according to claim 1, wherein the divided side wall is provided with a clamping means being arranged at the second horizontal folding line, said clamping means being used for clamping the upper side wall part and the lower side wall part together at times when folding is not desired.

4. Collapsible container according to claim 3, wherein the clamping means are movably integrated with the side wall.

* * * * *